US005927522A

United States Patent [19]

Carifa

[11] Patent Number: 5,927,522

[45] Date of Patent: Jul. 27, 1999

[54] TIGHTLOCK COUPLER LOCKLIFT ASSEMBLY

[75] Inventor: Mark R. Carifa, Reynoldsburg, Ohio

[73] Assignee: Buckeye Steel Castings Co., Columbus, Ohio

[21] Appl. No.: 08/869,657

[22] Filed: Jun. 5, 1997

Related U.S. Application Data

[60] Provisional application No. 60/040,611, Mar. 17, 1997.

[51] Int. Cl.[6] ..... B61G 7/00

[52] U.S. Cl. ..... 213/166; 213/170

[58] Field of Search ..... 213/115, 119, 213/124, 125, 128, 129, 130, 131, 133, 134, 139, 141, 153, 159, 161, 163, 164, 165, 166, 167, 168, 169, 170, 211, 218, 219

[56] References Cited

U.S. PATENT DOCUMENTS

| | | | |
|---|---|---|---|
| 985,450 | 2/1911 | Robinson | 213/163 |
| 1,973,873 | 3/1934 | Whitehouse et al. | 213/166 |
| 2,083,422 | 6/1937 | Bazeley | 213/167 |
| 2,803,354 | 8/1957 | Sale | 213/168 |
| 2,836,307 | 5/1958 | Wolfe | 213/166 |
| 3,021,964 | 2/1962 | Metzger | 213/167 |
| 3,102,644 | 9/1963 | Cope | 213/166 |
| 3,206,039 | 9/1965 | Metzger | 213/166 |
| 4,245,747 | 1/1981 | Roberts | 213/153 |
| 4,595,109 | 6/1986 | McClurg | 213/62 A |

OTHER PUBLICATIONS

A.A.R. Type H Tighlock Coupler and Attachments, Circular No. 1245, prepared by the Association of American Railroads, pp. 3–15, third printing, 1960.

*Primary Examiner*—Mark Tuan Le
*Attorney, Agent, or Firm*—Banner & Witcoff Ltd

[57] ABSTRACT

A railway Type H tightlock coupler locklift assembly for coupling railway cars comprises a Type H rotary locklift toggle, a Type H rotary locklift lever, and a rivet connecting the rotary locklift toggle to the rotary locklift lever. The Type H rotary locklift lever further comprises a standard flange or finger for operatively engaging a coupler operating rod and a second opposing flange or finger that abuts the coupler operating rod. The second opposing flange or finger prevents unintentional rotary motion of the rotary locklift lever by acting on or abutting against the locked operating rod, thereby preventing unintentional uncoupling of the railway cars when coupler components of such cars are struck by flying debris.

8 Claims, 5 Drawing Sheets

TIGHTLOCK COUPLER LOCKLIFT ASSEMBLY

This application claims the benefit of U.S. Provisional Application No. 60/040,611, filed Mar. 17, 1997.

BACKGROUND OF THE INVENTION

1. Field of the Invention

The present invention relates in general to railway car couplers and, in particular, to Type H tightlock couplers. More specifically, but without restriction to the particular use which is shown and described, this invention relates to Type H tightlock locklift assemblies having improved rotary locklift levers which prevent the unintentional uncoupling of railway cars.

2. Description of the Related Art

Constant effort has been made to improve the efficiency and safety of the tightlock coupler for passenger railway cars. In 1944, the Association of American Railroads ("A.A.R.") adopted the Type H Tightlock Coupler as the railroad standard for passenger car couplers. The Type H tightlock coupler was an improvement over the existing Type T coupler standard through design changes in the coupler head, coupler parts, and coupler operating mechanism. The standards for the A.A.R. Type H tightlock coupler can be found in the A.A.R. Type H Tightlock Coupler and Attachments, Circular No. 1245 and is incorporated by reference ("Circular No. 1245").

Traditionally, when it is desired to uncouple passenger train cars, rotary motion is applied through coupling operating rods to the rotary locklift assembly which is located at the bottom of Type H tightlock couplers. The rotary locklift assembly in turn makes contact with a lock, moving the lock slightly forward and upward. The lock then contacts a knuckle thrower horizontally rotating the knuckle thrower. The knuckle thrower in turn contacts a coupler knuckle causing the coupler knuckle to pivot and the coupler to open.

In the past, there have been occasions where passenger railway cars with standard type H tightlock couplers have accidentally uncoupled due to flying debris striking the coupler components. This accidental uncoupling is highly undesirable and the dangers are obvious as the passenger railway cars travel at high speeds. The accidental uncoupling results for example when the rotary locklift levers and other components of the Type H rotary locklift assemblies are struck by flying debris. Even when the coupler operating rods are in a locked mode, such strikes may cause rotary movement of the locklift assemblies and in turn cause the locks to move upward sufficiently to cause the knuckles to pivot out and the couplers to open. The unintentional opening of the couplers leads to the undesirable uncoupling of railway passenger cars.

The A.A.R. recognized the problem of accidental uncoupling and, in an attempt to increase the safety against this uncoupling, raised the fulcrum point of the rotary locklift lever and raised the lower portion of the lever so that the locklift lever is further away from the railroad tracks. See Circular No. 1245. This movement of the rotary locklift lever was intended to cause the coupler carrier to shroud the locklift lever. However, this was ineffective because the rotary locklift lever was only partially shrouded and the other components of the coupler operating mechanism were not prevented from moving or operating when struck by flying debris. Presently, railway passenger cars remain in danger of accidental uncoupling during high speed travel.

SUMMARY OF THE INVENTION

The present invention recognizes and provides a solution to the problems of unintentional uncoupling of railway cars in providing a tightlock coupler locklift assembly that has a unique rotary locklift lever which prevents unintentional rotary motion of the locklift assembly.

Accordingly, an object of the present invention is to provide for a tightlock coupler locklift assembly that prevents unintentional uncoupling of the railway cars. Another object of the present invention is to provide for a rotary locklift lever that has a flange or finger which prevents lifting of the lock even if components of the locklift assembly are struck by flying debris. Still another object of the invention is to provide for a rotary locklift lever that has a flange or finger that abuts the coupler operating rod, while in lockdown mode, and prevents the unintentional rotary motion of the rotary locklift lever. Yet another object of the invention is to provide a tightlock coupler locklift assembly that remains capable of being unlocked intentionally through unlocking of the coupler operating rod.

Briefly, in summary, the present invention provides a railway Type H tightlock coupler locklift assembly for coupling railway cars comprising a Type H rotary locklift toggle, a Type H rotary locklift lever, and a rivet connecting the rotary locklift toggle to the rotary locklift lever. The Type H rotary locklift lever further comprises a standard flange for operatively engaging a coupler operating rod and a unique second opposing flange or finger that abuts the coupler operating rod. As now contemplated and preferred, the second opposing flange or finger prevents unintentional rotary motion of the rotary locklift lever by acting on or abutting against the locked operating rod, thereby preventing unintentional uncoupling of the railway cars.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature.

In the accompanying drawing, like reference numerals are used throughout the various figures for identical structures.

DESCRIPTION OF THE PREFERRED EMBODIMENTS

Figure 1:
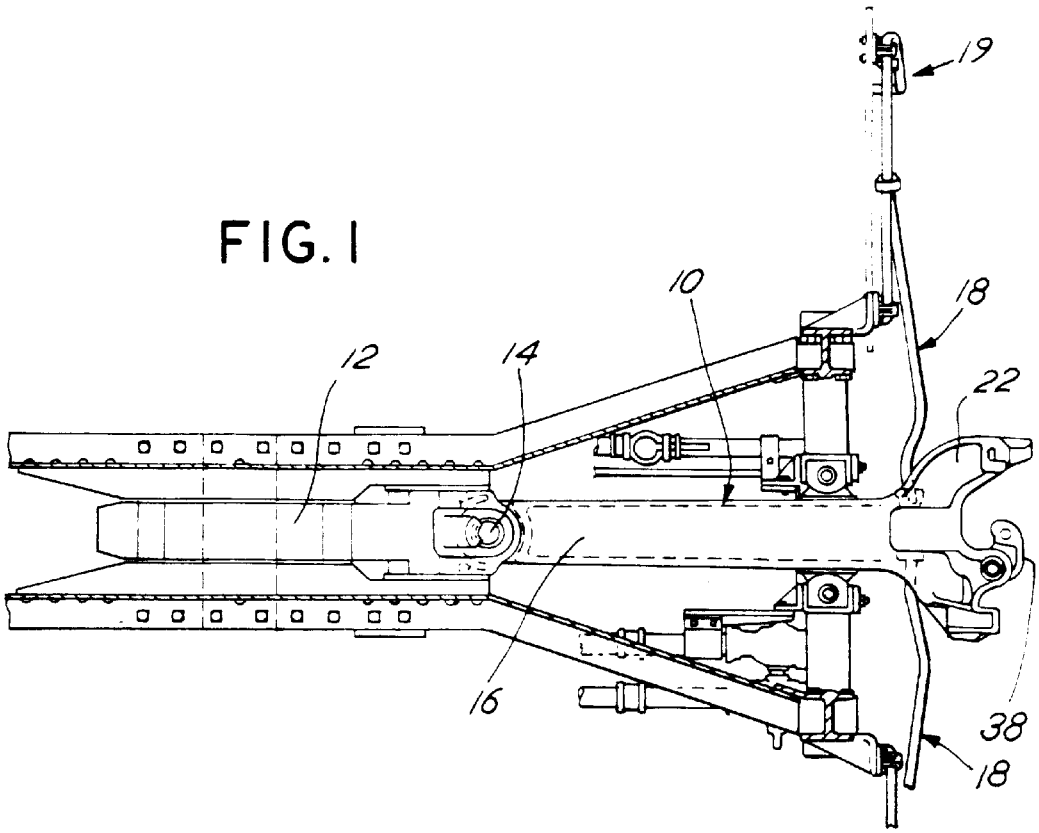
FIG. 1 is a plan view of a Type H tightlock coupler assembly.

Referring to FIG. 1, a standard A.A.R. Type H tightlock coupler 10 is illustrated in a typical railway passenger car application. The tightlock coupler 10 is connected to a tightlock coupler yoke 12 by means of a coupler shank pin 14. Coupler operating rods 18 are located adjacent the tightlock coupler 10 and are orientated approximately perpendicular to the plane defined by a coupler shank 16. The coupler operating rods 18, at one end, include operating rod handles 19 for manual operation of the operating rods 18. At the opposing end of the operating rod 18 is a J-hook 82 which engages a standard Type H rotary locklift assembly 20, not shown, located below a tightlock coupler head 22. Briefly, without describing the complex uncoupling action of the couplers 10, the manual operation of the operating rods 18 rotates a coupler knuckle 38, thereby uncoupling connected railcars.

Figure 2:
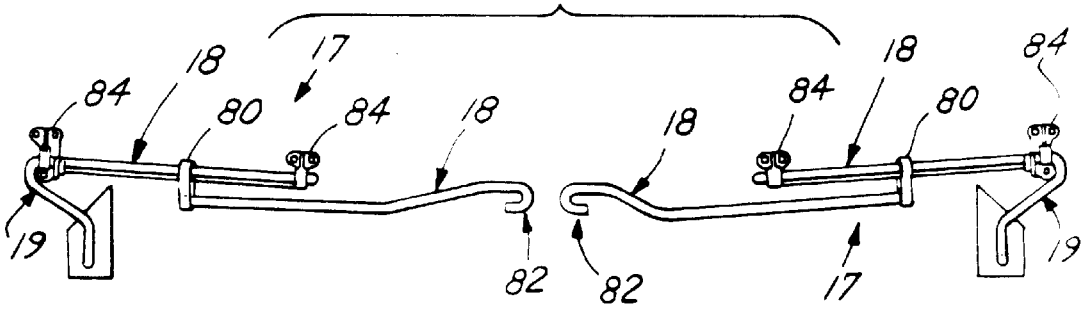
FIG. 2 is a front view of Type H operating rods.

Referring to FIG. 2, operating rod assemblies 17 are shown and comprise a pair of operating rods 18 connected by operating rod connectors 80. One operating rod 18 includes the operating rod handle 19 and the other operating rod 18 defines an operating rod J-hook 82. Operating rod brackets 84 connect and secure the operating rods 18 to the frame of the railway car and also allow rotational motion of the operating rods 18.

Figure 3:
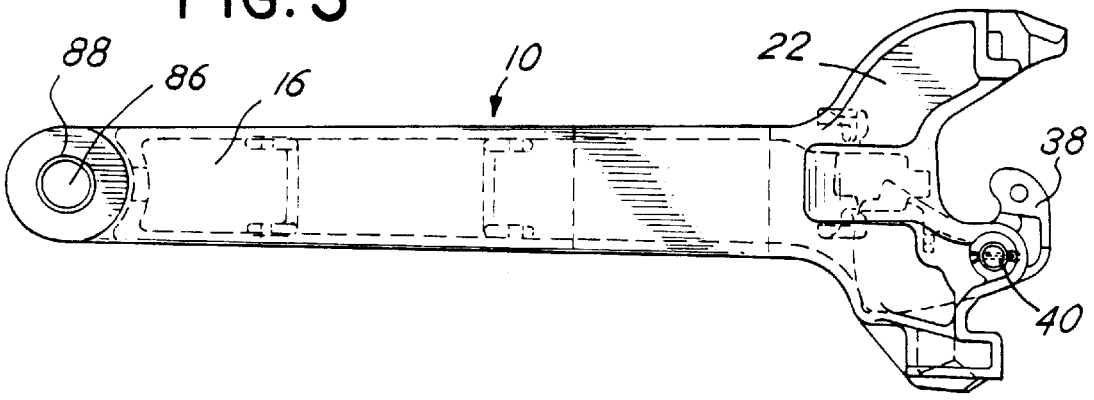
FIG. 3 is a plan view of a Type H tightlock coupler.
Figure 4:
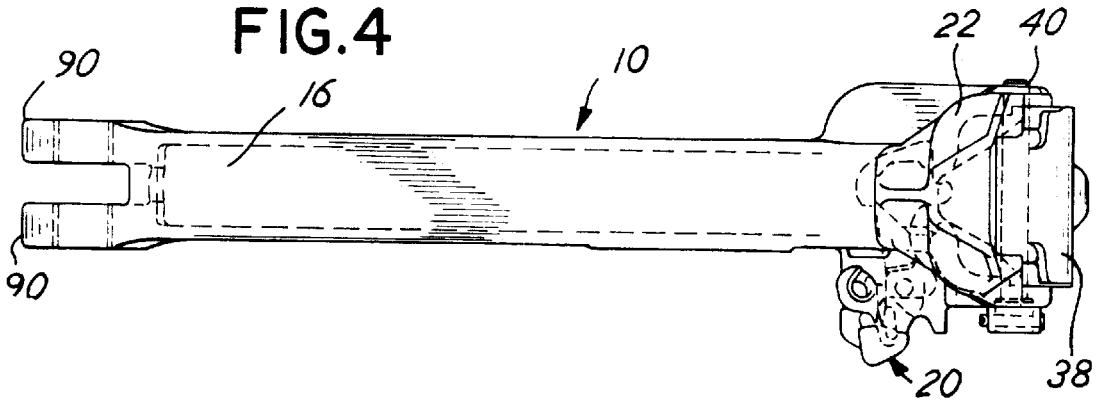
FIG. 4 is a side view of a Type H tightlock coupler.
Figure 5:
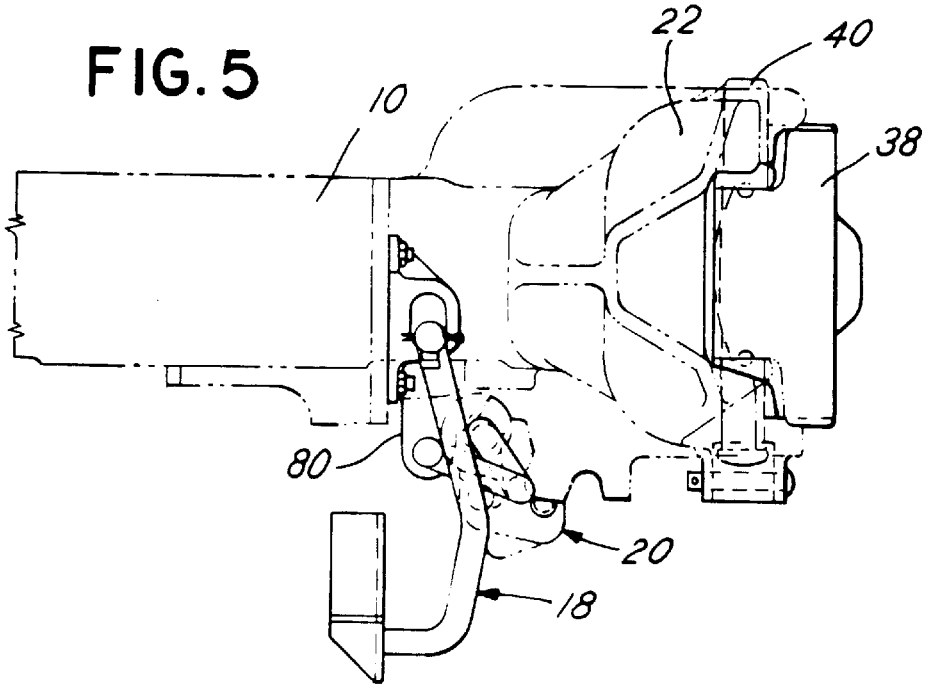
FIG. 5 is a partial side view of a Type H fightlock coupler engaged to a Type H operating rod.

Turning now to FIGS. 3–5, the Type H tightlock coupler 10, as indicated above, includes the coupler shank 16 and coupler head 22. In one embodiment of a Type H coupler 10, the coupler shank defines a shank pin hole 86, which is fitted with a bushing 88, and a pair of shank loops 90. As above, the coupler shank pin 14 couples the tightlock coupler 10 through the shank pin hole 86 to the coupler yoke 12 and allows limited rotational movement of the coupler 10 relative to the coupler yoke 12. The coupler knuckle 38 of the coupler head 22 is pivotally connected to the coupler head 22 by means of a knuckle pivot pin 40. The knuckle pivot pin 40 allows rotational motion of the coupler knuckle 38 for engagement and disengagement of coupler knuckles 38 of connected railway cars.

As shown in FIGS. 4 and 5, the standard Type H rotary locklift assembly 20, engages with the coupler operating rod 18. As indicated above and as will be fully described below, the rotary locklift assembly 20 and the coupler operating rod 18 are the components that, when intentionally operated, initiate the uncoupling of railway car couplers. Notably, the Type H locklift assembly 20 and the coupler operating rod 18 are located below the coupler head 22, within a few feet of the railroad tracks. It is the location of these coupler operating mechanisms and the dangers of accidental uncoupling of high speed passenger cars due to flying debris strikes which has prompted this significant invention.

Figure 6:
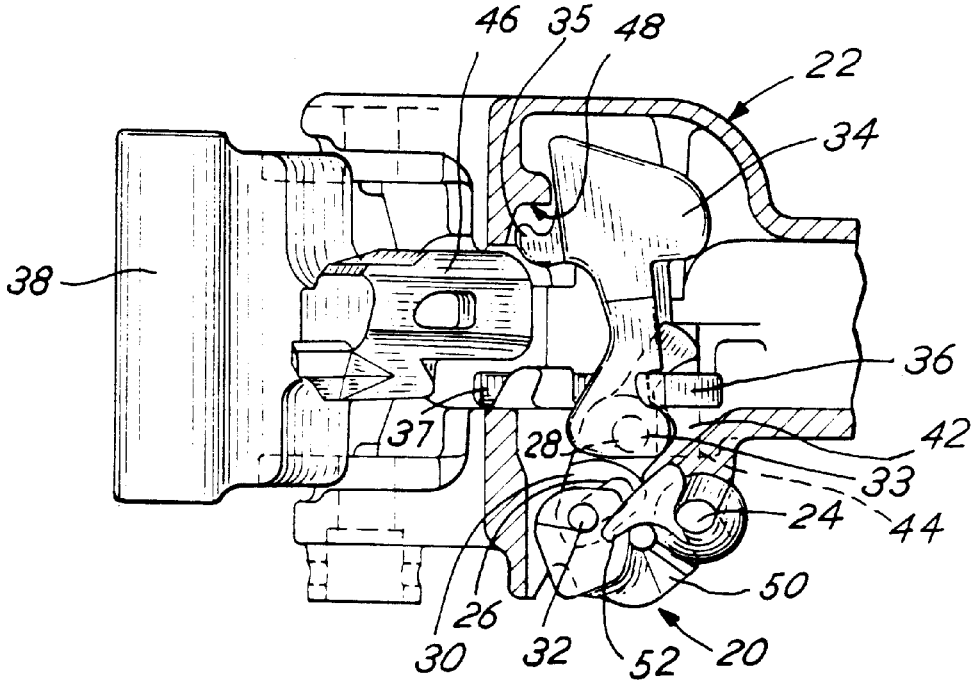
FIG. 6 is a partial cross-section side view of a Type H tightlock coupler head with a coupler knuckle open and partially removed.
Figure 7:
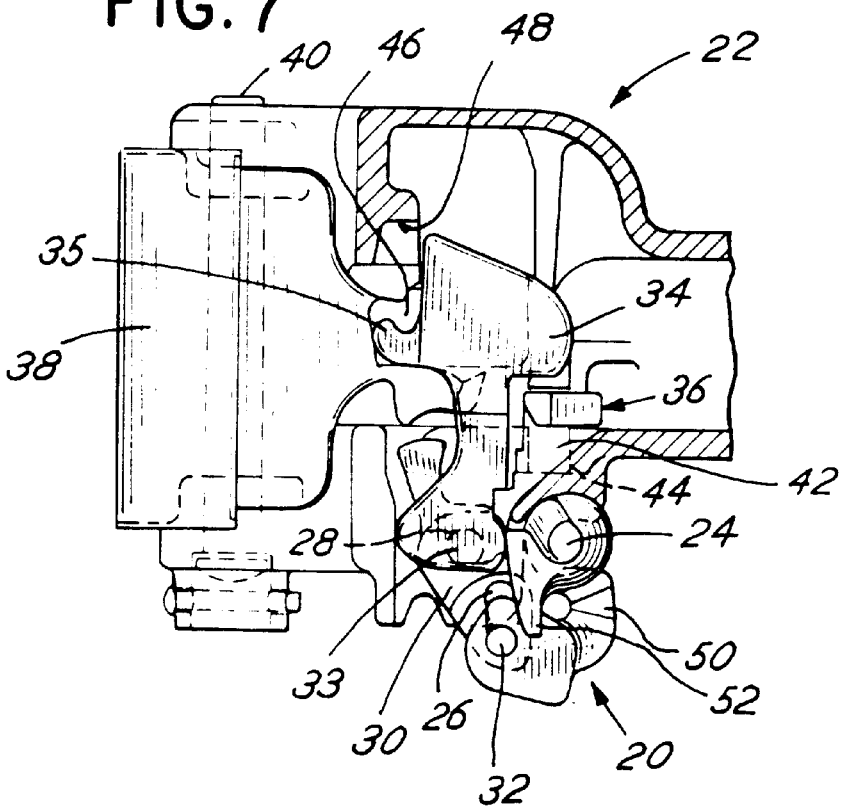
FIG. 7 is a partial cross-section side view of a Type H tightlock coupler head with a coupler knuckle closed.

Referring to FIGS. 6 and 7, the components of the standard A.A.R. Type H tightlock coupler are illustrated. The Type H rotary locklift assembly 20, as illustrated on page 7 of Circular No. 1245, is shown assembled in the coupler head 22. The Type H locklift assembly 20 comprises a Type H rotary locklift toggle 30, a Type H rotary locklift lever 50, such as A.A.R. Catalog No. H13AHT, and a rivet 32 connecting the rotary locklift toggle 30 to the rotary locklift lever 50.

Figure 10:
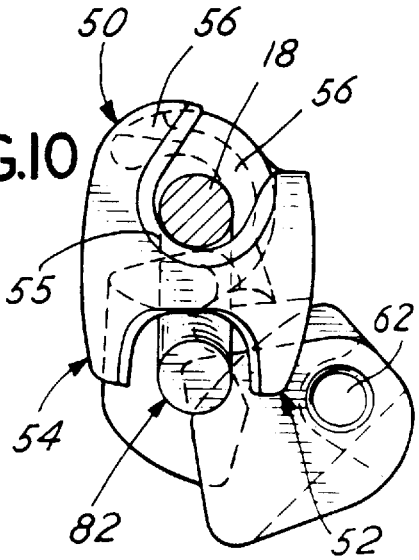
FIG. 10 is a side view of a rotary locklift lever of the present invention engaged to a Type H coupler operating rod.
Figure 11:
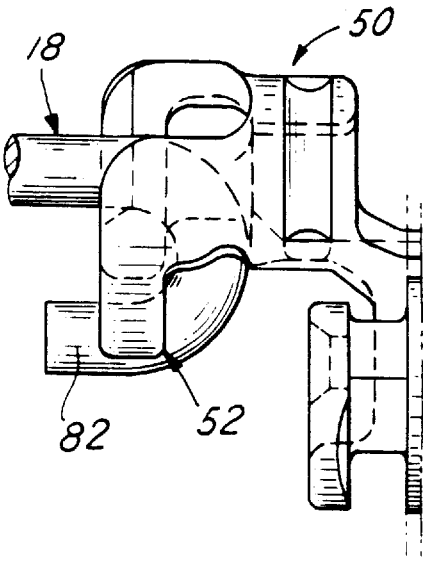
FIG. 11 is a partial front view of a rotary locklift lever of the present invention engaged to a Type H coupler operating rod.

The rotary locklift lever 50 of the rotary locklift assembly 20 has a standard flange or operating rod J-hook flange 52 which engages with the coupler operating rod J-hook 82 of the coupler operating rod 18, as illustrated in FIGS. 10 and 11. The locklift lever 50 is connected to a rote 24 of the tightlock coupler head 22 near the bottom of the tightlock coupler head 22. The rote 24 allows rotation of the locklift assembly 20 relative to the coupler head 22. The locklift toggle 30 defines a slot 26 that allows the locklift toggle 30 to slide and rotate relative to the locklift rivet 32 and the locklift lever 50. The locklift toggle 30 also defines a toggle hole 28 which receives a lock trunnion 33 of a standard Type H tightlock coupler lock 34 for pivotally connecting the lock 34 to the locklift toggle 30. The lock 34 has a fulcrum 35 and is disposed adjacent to a knuckle thrower 36 and the tightlock coupler knuckle 38. The knuckle thrower 36 defines a knuckle thrower actuating leg 37 and a thrower trunnion 42 that lies in a knuckle thrower trunnion hole 44 of the coupler head 22. The coupler knuckle 38 includes a knuckle tail 46 and is connected to the coupler head 22 by the knuckle pivot pin 40.

In order to intentionally open the coupler knuckle 38 and thereby uncouple connected railway cars, manual rotational force is applied to the operating rod handle 19 of the coupler operating rod 18, through the operating rod J-hook 82, which in turn acts on or engages the flange 52 of the locklift lever 50. The manual rotational force on the flange 52 of the locklift lever 50 caused by the rotational action of the operating rod J-hook 82, results in rotary motion of the locklift lever 50. The locklift lever 50 rotates on the rote 24 of the coupler head 22. The rotational force of the locklift lever 50 transmits to the connected locklift toggle 30 and then to the connected coupler lock 34, thereby vertically lifting the coupler lock 34. The coupler lock 34 will travel in a substantially vertical direction until the fulcrum 35 of the coupler lock 34 contacts a housing wall shoulder 48 of the coupler head 22 at which point the coupler lock 34 pivots about the contact point of the fulcrum 35 to the housing wall shoulder 48. The coupler lock 34 pivots rearward away from the coupler knuckle 38 and then contacts the knuckle thrower 36 and causes the knuckle thrower 36 to rotate about the knuckle thrower trrnnion 42 within the knuckle thrower trunnion hole 44. The knuckle thrower actuating leg 37 of the knuckle thrower 36 in turn contacts the knuckle tail 46 of the coupler knuckle 38 and causes rotary motion of the coupler knuckle 38 about the knuckle pivot pin 40, thereby opening the coupler knuckle 38. The opening of the coupler knuckle 38 results in the uncoupling of connected railway cars.

As exemplified by FIGS. 8–12, the preferred, inventive Type H rotary locklift lever 50 has the standard operating rod J-hook flange 52 for operatively engaging the J-hook 82 of the coupler operating rod 18 and a unique opposing flange or finger 54. The inventive opposing flange 54 is located adjacent the operating rod 18 and abuts the coupler operating rod 18, while the operating rod 18 is in a lockdown mode. The preferred locklift lever 50 further defines a rotary locklift rivet hole 62, an operating rod J-hook eye 55 and pivot hooks 56. The rotary locklift rivet hole 62 of the locklift lever 50 is sized to fit with the rivet 32, which couples the locklift lever 50 to the rotary locklift toggle 30. The pivot hooks 56 receive the rote 24 of the coupler head 22 and allow rotation of the locklift assembly 20 relative to the coupler head 22. As shown in FIGS. 10 and 11, the J-hook 82 of the operating rod 18 is mounted over the operating rod J-hook eye 55, thereby hooking and engaging the operating rod 18 to the rotary locklift lever 50.

As most preferred, the flange 54 prevents unintentional rotary motion of the rotary locklift lever 50 while in the lockdown mode, thereby preventing unintentional uncoupling of the railway cars. With the flange 54, the locklift lever 50 cannot turn and lift the lock 34 even if components of the locklift assembly 20 are struck by flying debris, thereby preventing opening of the coupler. With the present invention, the rotary motion of the locklift assembly 20 is restricted by the operating rod because the flange or finger 54 acts on or abuts against the J-hook 82 of the locked operating rod 18. Without the flange 54, a flying debris strike of the locklift assembly 20 has and will continue to cause the locklift assembly 20 to unintentionally rotate about the rote 24, thereby lifting the lock 34 and opening the coupler knuckle 38. Note that the locklift assembly 20 with the unique flange 54 remains capable of being unlocked intentionally through unlocking of the operating rod 18.

Figure 12:
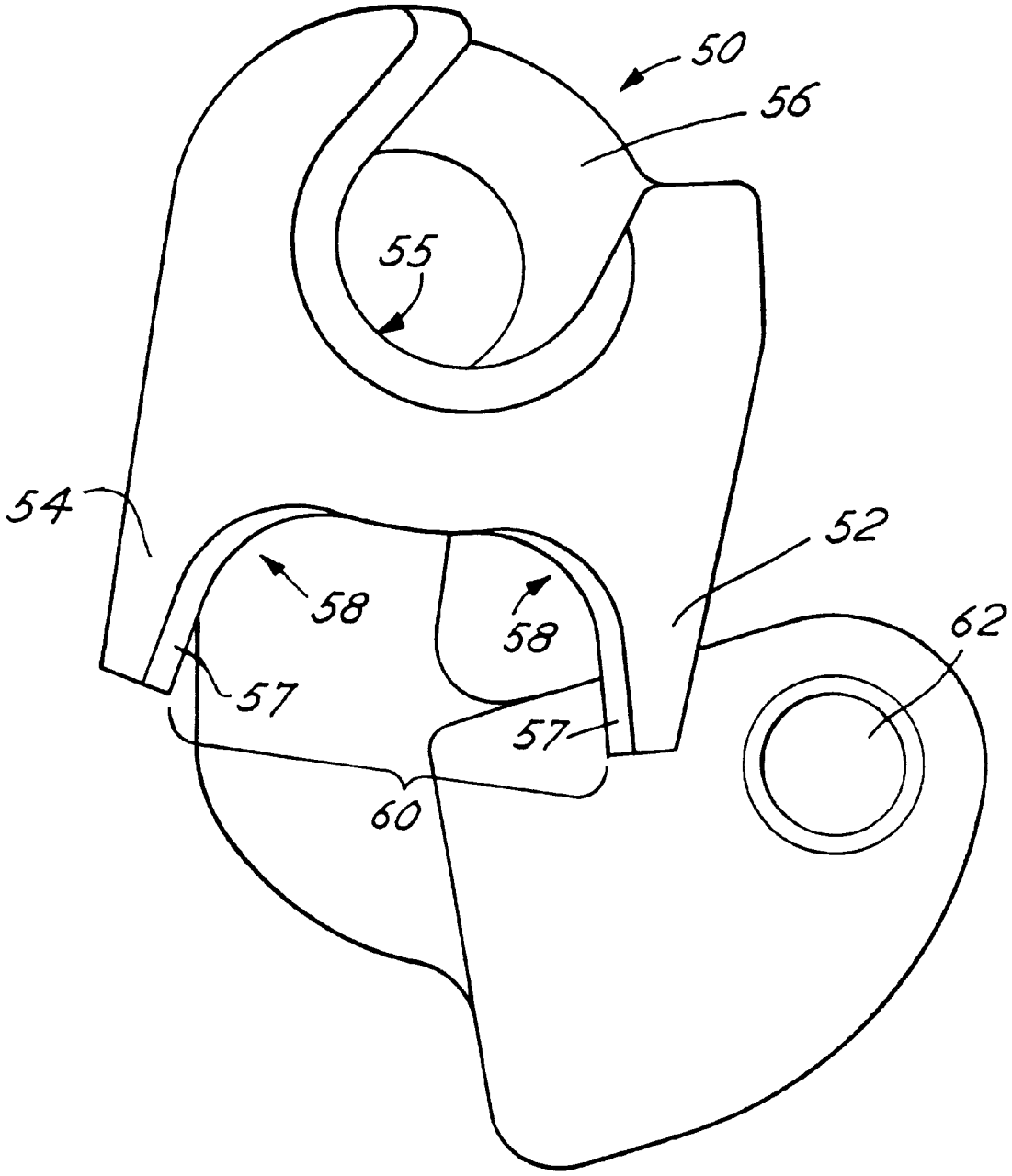
FIG. 12 is a side view of a rotary locklift lever of the present invention.

In FIG. 12, the standard Type H flange 52 and opposing inventive flange 54 is shown in a side view of a Type H single rotary locklift lever 50. With the Type H single locklift lever 50, the locklift assembly requires opening of the assembly from the side of the assembly having the opposed flange 54. It is also within the scope of the invention that the flange 54 of the locklift lever 50 may be used with a Type H double rotary locklift lever wherein two standard flanges 52 are located on opposite ends of the rotary locklift lever. See Circular No. 1245, p. 7. With a Type H double rotary locklift lever, the locklift assembly 20 can be opened from either side of the assembly. In the double rotary locklift lever embodiment, an opposing flange 54 according to the present invention may be located opposite one or both of the two standard flanges 52. Note that whichever side(s) of the locklift assembly 20 has the flange 54, in order for the coupler to open, the operating rod 18 must not be in the lockdown mode.

Figure 8:
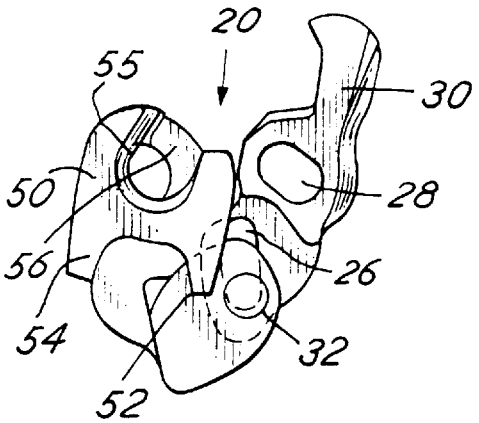
FIG. 8 is a side view of a Type H rotary locklift assembly of the present invention.
Figure 9:
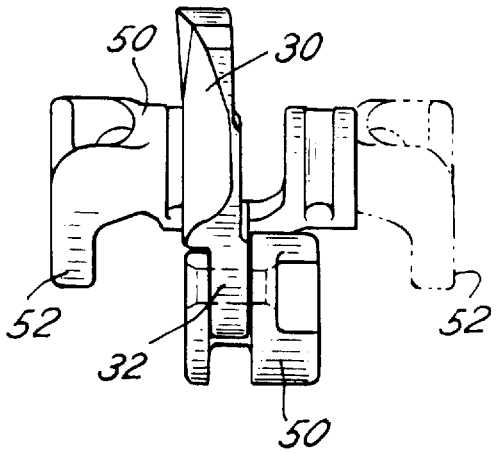
FIG. 9 is a front view of a Type H rotary locklift assembly.

As illustrated in FIGS. 8, 10 and 12, the opposing flange 54 is cast integral with the locklift lever 50. However, welding of the flange 54 to the rotary locklift lever 50, or other methods of forming or attaching the flange 54 to the rotary locklift lever 50 are contemplated and within the scope of this invention. In addition, it is contemplated that the flanges 52 and 54 be connected so as to encircle or enclose the operating rod J-hook 82 of the operating rod 18.

In a preferred embodiment, the opposing flange 54 forms out of the locklift lever 50 and extends in parallel relation to the locklift lever flange 52. In this embodiment of the present invention, the shape of flange 54 substantially mirrors the standard Type H locklift lever flange 52. Thus, the thickness, width, and length are approximately the same. However, modifications to the thickness, width, length, and general overall shape of the flange 54 are contemplated and within the scope of the invention.

Moreover, flanges 52 and 54 define a curved recess resulting in a gap 60 between the inner walls 57 of the flanges. Each flange 52 and 54 forms an inner curve 58 having an adequate radius for strength and stress distribution. Thus, the curved recess is substantially U-shaped. The gap 60 between the inner walls 57 of the opposing flanges is sized to allow the coupler operating rod 18 to fit within the gap 60. That is, the gap 60 between the inner walls 57 is greater than the diameter of the standard coupler operating rod 18 to accommodate the operating rod 18 and also allow some minimal movement of the operating rod 18 within the gap 60. Moreover, the gap 60 allows for angular change between the operating rods 18 and the coupler 10 as the coupler 10 moves side to side when the railway car travels around curves. The remaining features of the locklift lever 50 are conventional and common with the standard A.A.R. Type H locklift levers. See Circular No. 1245.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. A railway Type H tightlock coupler locklift assembly for coupling railway cars comprising:

a Type H rotary locklift toggle, a Type H rotary locklift lever having pivot hooks for rotatably receiving rotes of a coupler head, the pivot hooks defining a coupler operating rod eye for receiving a coupler operating rod, the rotary locklift lever also having a first flange for operatively engaging a coupler operating rod J-hook of the coupler operating rod and a second opposing flange, the first and second flanges formed integral with the pivot hooks of the locklift lever and extend outward in parallel relation from the pivot hooks, and a rivet connecting the rotary locklift toggle to the rotary locklift lever, whereby the second opposing flange of the rotary locklift lever abuts the coupler operating rod J-hook mounted through the coupler operating rod eye and over the pivot hooks and prevents unintentional rotary motion of the rotary locklift lever about the rote of the coupler head, thereby preventing unintentional uncoupling of the railway cars.

2. The railway Type H tightlock coupler locklift assembly as in claim 1, wherein the second opposing flange substantially mirrors the first flange.

3. The railway Type H tightlock coupler locklift assembly as in claim 1, wherein the first flange and second opposing flange define a recess.

4. A railway Type H tightlock coupler locklift assembly for coupling railway cars comprising:

a Type H rotary locklift toggle, a Type H rotary locklift lever having pivot hooks for rotatable receiving rotes of a coupler head, the pivot hooks defining a coupler operating rod eye for receiving a coupler operating rod, the rotary locklift lever also having a first flange and a second opposing flange, the first flange operatively engaging an operating rod having a diameter, the first flange and second opposing flange defining a recess, the recess sized to fit with the diameter of the operating rod, the first and second flanges formed integral with the pivot hooks of the locklift lever and extend outward in parallel relation from the pivot hooks, and a rivet connecting the rotary locklift toggle to the rotary locklift lever, whereby the second opposing flange of the rotary locklift lever abuts the coupler operating rod mounted through the coupler operating rod eye and over the pivot hooks and prevents unintentional rotary motion of the rotary locklift lever about the rote of the coupler head, thereby preventing unintentional uncoupling of the railway cars.

5. The railway Type H tightlock coupler locklift assembly as in claim 4, wherein the recess is curved.

6. The railway Type H tightlock coupler locklift assembly as in claim 4, wherein the recess is substantially U-shaped.

7. The railway Type H tightlock coupler locklift assembly as in claim 4, wherein the second opposing flange substantially mirrors the first flange.

8. A railway car coupler locklift lever comprising:

pivot hooks for rotatably receiving rotes of a coupler head, a coupler operating rod eye defined by the pivot hooks for receiving a coupler operating rod, a first flange and a second flange, the first flange operatively engaging a coupler operating rod, the second flange being adjacent the coupler operating rod, the first and second flanges formed integral with the pivot hooks and extend outward in parallel relation from the pivot hooks, whereby the second flange abuts the coupler operating rod and prevents unintentional rotary motion of the locklift lever and thereby prevents unintentional uncoupling of the railway cars.

* * * * *